US007771026B2

(12) United States Patent
Ide et al.

(10) Patent No.: US 7,771,026 B2
(45) Date of Patent: Aug. 10, 2010

(54) INK JET RECORDING HEAD AND LIQUID JETTING METHOD

(75) Inventors: Shuichi Ide, Tokyo (JP); Mineo Kaneko, Tokyo (JP); Ken Tsuchii, Sagamihara (JP); Toru Yamane, Yokohama (JP); Masaki Oikawa, Inagi (JP); Keiji Tomizawa, Yokohama (JP); Mitsuhiro Matsumoto, Yokohama (JP); Kansui Takino, Kawasaki (JP); Naozumi Nabeshima, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 424 days.

(21) Appl. No.: 11/866,695

(22) Filed: Oct. 3, 2007

(65) Prior Publication Data

US 2008/0239011 A1 Oct. 2, 2008

(30) Foreign Application Priority Data

Oct. 4, 2006 (JP) ..... 2006-272985

(51) Int. Cl.
*B41J 2/05* (2006.01)

(52) U.S. Cl. ..... 347/62; 347/65

(58) Field of Classification Search ..... 347/20, 347/44, 47, 54, 56, 61–65, 67
See application file for complete search history.

(56) References Cited

U.S. PATENT DOCUMENTS

| | | | | |
|---|---|---|---|---|
| 5,218,376 | A | 6/1993 | Asai | |
| 5,706,041 | A * | 1/1998 | Kubby | 347/65 |
| 5,751,315 | A * | 5/1998 | Burke et al. | 347/63 |
| 6,499,832 | B2 | 12/2002 | Lee et al. | |
| 6,834,940 | B2 | 12/2004 | Sugioka et al. | |
| 6,974,209 | B2 | 12/2005 | Silverbrook | |

FOREIGN PATENT DOCUMENTS

| | | |
|---|---|---|
| JP | 54-161935 | 12/1979 |
| JP | 61-185455 | 8/1986 |
| JP | 61-249768 | 11/1986 |

* cited by examiner

*Primary Examiner*—Juanita D Stephens
(74) *Attorney, Agent, or Firm*—Fitzpatrick, Cella, Harper & Scinto

(57) ABSTRACT

A liquid recording head includes a thermal energy generating element, having a flat plate configuration, for generating a bubble by thermal energy; a pressure chamber in which the thermal energy generating element is provided; a flow path for introducing liquid into the pressure chamber; a supply port in fluid communication with the flow path; and an ejection outlet provided at a position opposing the thermal energy generating element in fluid communication with the pressure chamber. The thermal energy generating element includes a first major surface facing the ejection outlet and a second major surface opposite the first major surface, and a distance between the first major surface and a ceiling surface of the pressure chamber in which the ejection outlet is formed is shorter than a distance between the second major surface and a bottom surface of the pressure chamber.

9 Claims, 10 Drawing Sheets

INK JET RECORDING HEAD AND LIQUID JETTING METHOD

FIELD OF THE INVENTION AND RELATED ART

The present invention relates to an ink jet recording head and a liquid jetting method, which are for recording on recording medium by jetting liquid (ink).

In recent years, the number of recording apparatuses in use has been rapidly increasing. With the increase, demand has been increasing for recording apparatuses which are higher in recording speed, resolution, and image quality, and also, lower in noise. One of the recording apparatuses which can be listed as a recording apparatus capable of meeting such demand is an ink jet recording apparatus. An ink jet recording apparatus is structured to record an image on recording medium by jetting droplets of ink (liquid) from its liquid outlets so that the droplets adhere to the recording medium.

There are various ink jetting methods employed by an ordinary ink jet recording apparatus, for example, a method which uses an electrothermal transducer, such as a heater, and a method which uses a piezoelectric element. In both methods, jetting of ink can be controlled by an electric signal.

The principle used for jetting ink with use of an electrothermal transducer is as follows: The body of ink in the adjacencies of an electrothermal transducer is instantly boiled by the application of voltage to the electrothermal transducer, and the sudden increase in pressure caused by the change in the phase of ink resulting from the boiling is used to jet the ink in the form of a droplets, at a high speed.

The principle used for jetting ink with the use of a piezoelectric element is as follows: As voltage is applied to a piezoelectric element, the piezoelectric element is displaced. This displacement of the piezoelectric element is used to jet ink in the form of a droplet.

An ink jet recording head which employs an electrothermal transducer as a means for jetting ink is advantageous in that it does not take up a large space, and is simple in structure. Further, the employment of an electrothermal transducer makes it easier to form a large number of liquid passages as integral parts of an ink jet recording head. On the other hand, it suffers from a problem peculiar to an ink jet recording head employing an electrothermal transducer. That is, the heat generated by an electrothermal transducer accumulates in the recording head, and varies the amount (volume) by which ink is jetted out in the form of a droplet, which results in the formation of a low quality image.

As the solutions to the above described problem, Japanese Laid-open Patent Applications S54-161935, S61-185455, S61-249768, and U.S. Pat. No. 5,218,376 disclose ink jet recording methods and ink jet recording heads. More specifically, in the case of the ink jet recording methods and ink jet recording heads disclosed in the abovementioned publications, the recording heads are designed so that the bubbles generated by driving electrothermal transducers with the use of recording signals are released into the ambient air. The employment of any of these combinations of an ink jet recording method and an ink jet recording head makes it possible to stabilize the volume by which ink is jetted in the form of a minute droplet at a high speed. Therefore, it makes it possible to easily obtain an image which is substantially more precise than an image obtainable by an ink jet recording apparatus in accordance with the prior art. In the case of the ink jet recording apparatuses, disclosed in the abovementioned patent publications, which are structured to release the bubbles into the ambient air, the minimum distance between the electrothermal transducer for generating bubbles in ink, and the outlet through which liquid (ink) is jetted, is rendered substantially shorter than that in an ink jet recording apparatus in accordance with the prior art.

Presently, by the way, the speed and level of image quality at which an ink jet printer is required to form an image is even higher.

There have been known a few reasons why even the employment of any of the ink jet recording methods described above results in the formation of an unsatisfactory image. One of them is the occurrence of satellite liquid (ink) droplets, that is, the liquid (ink) droplets other than the primary liquid (ink) droplet. Thus, in order to achieve a high level of image quality, an image forming apparatus must significantly reduce the number and size of the satellite liquid (ink) droplets which it forms.

One of the methods for reducing the number and size of the satellite liquid (ink) droplets formed by an ink jet recording apparatus is disclosed in U.S. Pat. No. 6,499,832. According to this U.S. patent, the ink jet recording head is structured to prevent ink from flowing backward in the ink outlet portion of the ink jet recording head when an ink droplet is formed. In other words, the ink jet recording head is structured such that the process of forming a primary droplet ends before the bubble begins to collapse.

As for the ink jet recording head design, there is a so-called side shooter type. In order to reduce the number and size of the satellite ink droplets formed by a side shooter ink jet recording apparatus, the distance between a heater and the corresponding ink outlet is desired to be small enough for a bubble to come into contact with the ambient air while it is growing to jet liquid in the form of a minute droplet.

However, the reduction in the distance between a heater and corresponding ink outlet narrows the corresponding ink passage, reducing thereby the side shooter ink jet recording head in refill speed.

As for an ink jet recording head design which does not reduce a side shooter ink jet recording head in refill speed, it is possible to form a projection 102*a* on the substrate of an ink jet head chip, and place a heater 101 on top of the projection 102*a* so that only the heater 104 is placed closer to the bottom end of an ink outlet 104, as shown in FIG. 9.

However, if a side shooter ink jet recording head is structured as shown in FIG. 9, each bubble generated for jetting ink comes into contact with the ambient air while it grows. Thus, ink is made to flow toward the ink supply chamber even after the occurrence of contact between the bubble and ambient air, as shown in FIG. 10, making it difficult for the bubble generation chamber to be quickly refilled.

FIGS. 10A-E are schematic sectional views of an example of a side shooter ink jet recording head in which the heater 101 is on top of the projection 102*a*, and shows the manner in which ink is jetted and the manner in which the bubble generation chamber is refilled with ink.

FIG. 10A shows the state of the ink jet recording head prior to bubble generation: the heater has not received a driving signal, and bubble generation has not begun.

FIG. 10B shows the state of the ink jet recording head immediately after the beginning of bubble generation: the heater has received a driving signal, and the heater has begun to generate heat, initiating thereby bubble generation. As the bubble begins to grow, the process of jetting an ink droplet from the ink outlet 104 begins, and also, ink begins to flow in an ink supply passage 109, toward the ink supply chamber 106.

FIG. 10C shows the state of the ink jet recording head immediately before the bubble comes into contact with the ambient air: ink is still flowing toward the ink supply chamber 106, in the ink supply passage 109.

FIG. 10D shows the state of the ink jet recording head immediately after the bubble came into contact with the ambient air. In this ink jet recording head, the heater 101 is on top of the projection 102*a*, being therefore closer to the ink outlet 104 than a heater (101) in an ink jet recording apparatus in which the heater is not on top of the projection (102*a*). Therefore, the bubble comes into contact with the ambient air when it is still growing. Therefore, the bubble prevents the formation of satellite ink droplets. As for the ink flow in the ink supply passage 109 toward the ink supply chamber 106, it is weaker than that before the occurrence of contact between the bubble and ambient air.

FIG. 10E shows the state of the ink jet recording head during the refilling. The bubble generation chamber is refilled with the body of ink, which flows toward the heater 101 from the ink supply chamber 106. However, the presence of the projection 102*a* in the ink supply passage 109 makes narrower the portion of the ink supply passage 109, in which the projection 102*a* is present. Thus, the ink jet recording apparatus, in accordance with the prior art, in which the heater 1 is on top of the projection 102*a*, is lower in refill efficiency. (direction indicated by arrow mark b in drawing).

SUMMARY OF THE INVENTION

The present invention was made in consideration of the problems described above, and therefore, can provide an ink jet recording head which forms a significantly smaller number and size of the satellite ink droplets, and yet, is no less in refill efficiency than an ink jet recording head in accordance with the prior art, each of the heaters of which is on the bottom surface of the corresponding pressure chamber.

According to an aspect of the present invention, there is provided thermal energy generating means, having a flat plate configuration, for generating a bubble by thermal energy; a pressure chamber in which said thermal energy generating means is provided; a flow path for introducing liquid into said pressure chamber; a supply port in fluid communication with said flow path; and an ejection outlet provided at a position opposing said thermal energy generating means in fluid communication with said pressure chamber, wherein said thermal energy generating means includes a first major surface facing said ejection outlet and a second major surface opposite said first major surface, and wherein a distance between said first major surface and ceiling surface of said pressure chamber in which said ejection outlet is formed is shorter than a distance between said second major surface and a bottom surface of said pressure chamber.

According to the present invention, it is possible to reduce the number and size of the satellite ink droplets formed by a side shooter ink jet recording apparatus, without reducing the recording apparatus in refill efficiency.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the preferred embodiments of the present invention will be described in detail with reference to the appended drawings.

<Brief Description of Apparatus Main Assembly>

Figure 1:
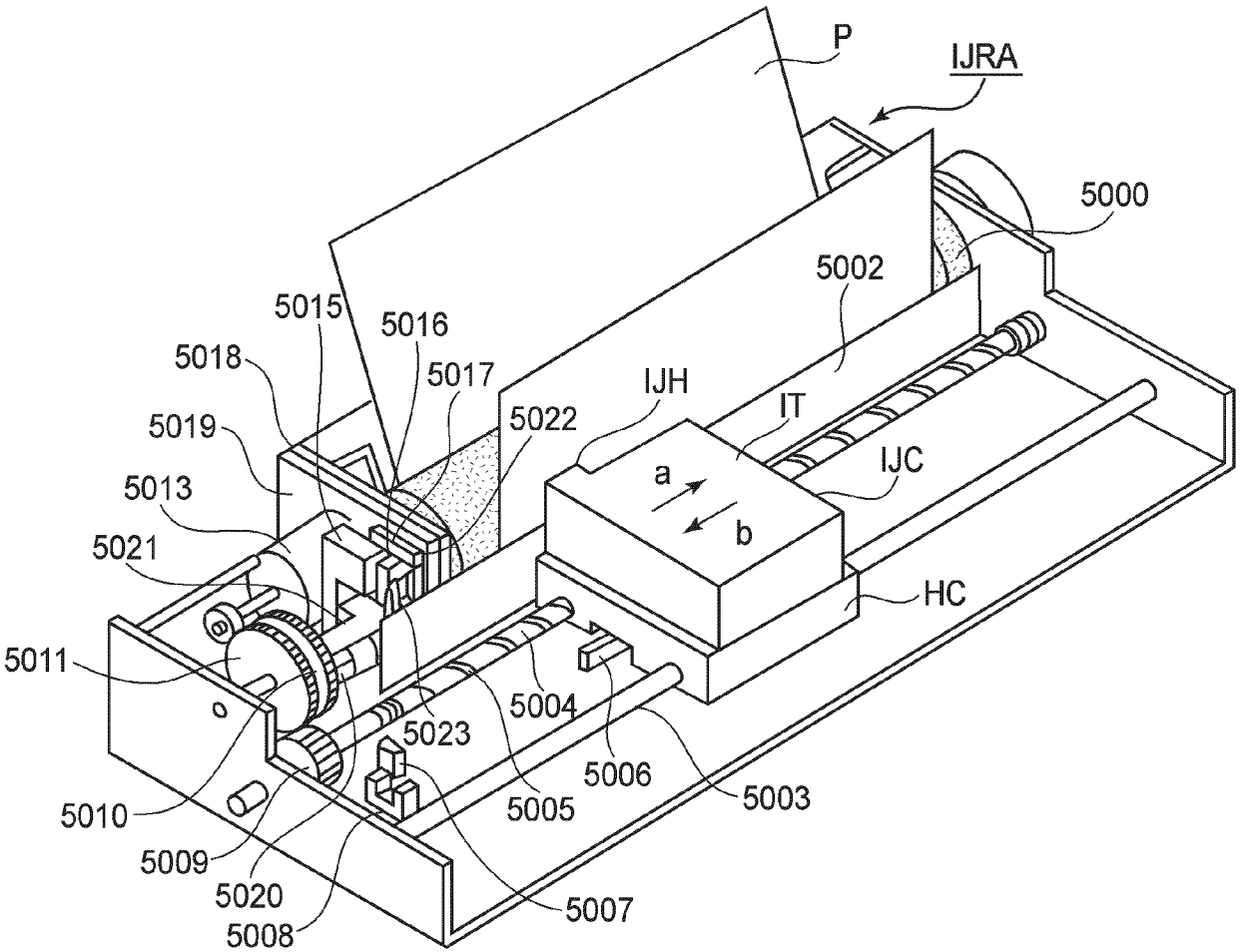
FIG. 1 is an external perspective view of a typical ink jet printer IJRA in accordance with the present invention, showing the structure thereof.

FIG. 1 is an external perspective view of a typical ink jet printer IJRA in accordance with the present invention, and shows the structure of the printer. A carriage HC has a pin (unshown), which is engaged in the spiral groove 5005 of a lead screw 5004. The lead screw 5004 is rotated by the forward or reverse rotation of a motor 5013 through the driving force transmission gears 5009-5011. The carriage HC is supported by a guide rail 5003, and shuttles as indicated by arrow marks a and b. Supported by the carriage HC is an ink jet cartridge unit made up of an ink jet recording head IJH and an ink container IT. A paper pressing plate 5002 keeps a sheet of recording paper P upon a platen 5000 across the entirety of the moving range of the carriage HC.

Photocouplers 5007 and 5008 are home position detecting devices, which detect the presence of the lever 5006 of the carriage HC to determine whether or not the carriage HC is in its home position, in order to switch the rotational direction of the motor. A supporting member 5016 is a member which supports a capping member 5022 which is for capping the front surface of the recording head HC. A suctioning device 5015 suctions the liquid (ink) in the recording head IJH through the opening 5023 of the capping member 5022 to restore the recording head IJH in performance. A member 5019 is a member for enabling a cleaning blade 5017 to move forward or backward. The member 5019 and cleaning blade 5017 are supported by a main assembly supporting plate 5018. Needless to say, any of known cleaning blades (5017) can be used in place of the cleaning blade 5017. A lever 5021 is for initiating the suctioning process for restoring the recording head IJH. It is moved by the movement of a cam 5020 which engages with the carriage HC.

The ink jet printer IJRA is structured so that the capping, cleaning, and suction-based performance recovery processes are carried out at preset positions, in the adjacencies of the home position of the carriage HC, by the function of the lead screw 5004. Obviously, any structural arrangement is compatible with this embodiment, as long as it can make the ink jet printer IJRA to perform a desired process(es) with the known timing.

<Description of Control Portion Structure>

Next, the control portion of the above described apparatus, which is for controlling the recording operation of the apparatus, will be described.

Figure 2:
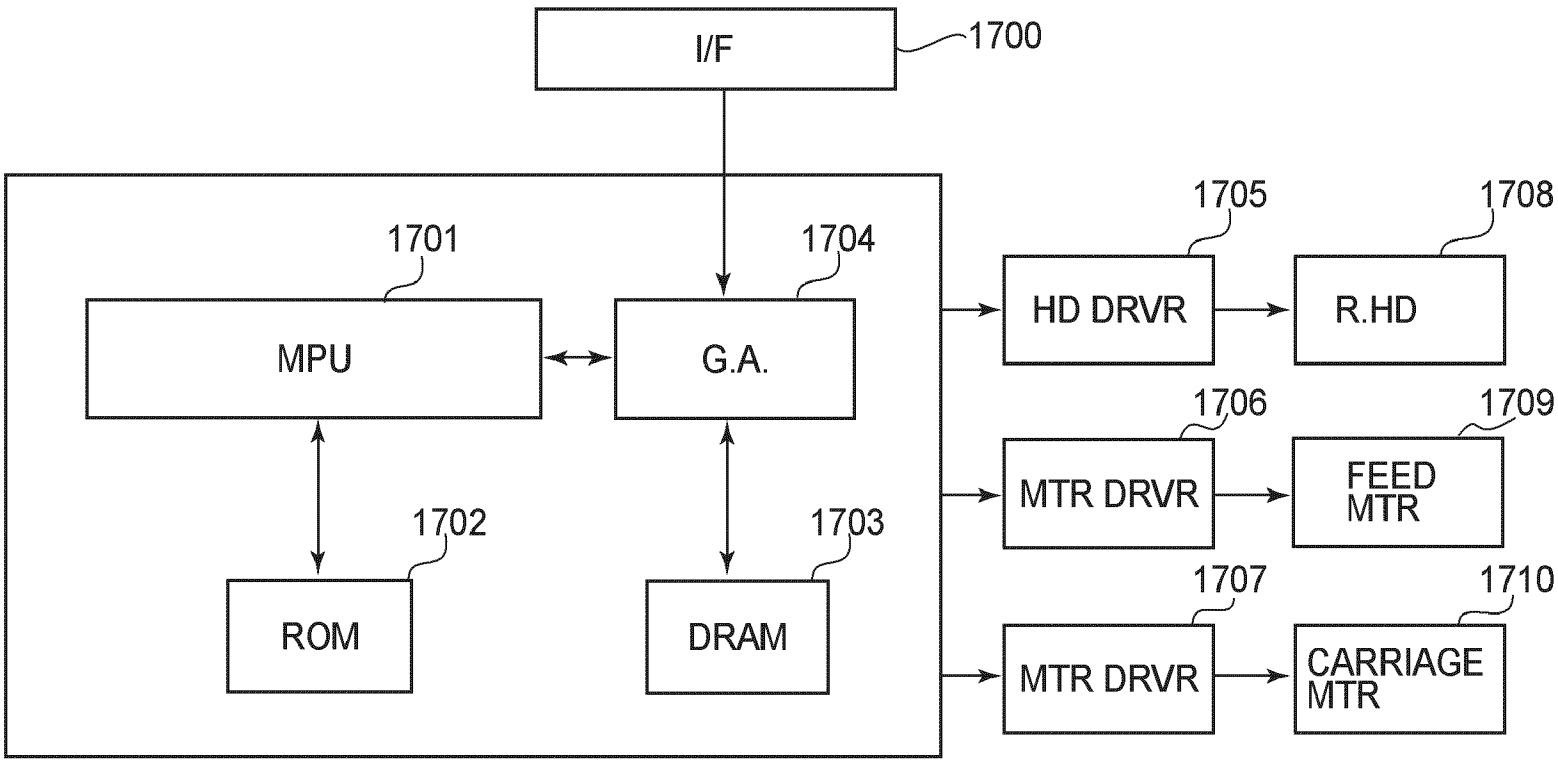
FIG. 2 is a block diagram of the control circuit of the ink jet recording apparatus, showing the structure thereof.

FIG. 2 is a block diagram of the control circuit of the ink jet recording apparatus IJRA, and shows the structure of the circuit. In this drawing of the control circuit, an interface 1700 is a portion through which recording signals are inputted. A ROM 1702 stores the control programs which are carried out by an MPU 1701. A DRAM 1703 stores various data (above-mentioned recording signal, recording data to be supplied to recording head IJH, etc.). A gate array (G.A.) 1701 controls the process of supplying the recording head IJH with recording data, and also, controls the data transfer among the interface 1700, MPU 1701, and RAM 1703. A carrier motor 1710 is the motor for conveying the recording head IJH. A conveyer motor 1709 is the motor for conveying sheets of recording paper. A head driver 1705 drives the recording head IJH. Motor drivers 1706 and 1707 drive conveyer motor 1709 and carrier motor 1710, respectively.

Next, the operation of the control circuit structured as described above will be described. As recording signals enter the interface 1700, they are converted into recording data for the printer, between the gate array 1704 and MPU 1701. Then, the motor drivers 1706 and 1707 are driven, and also, the recording head IJH is driven, according to the recording data sent to the head driver 1705. As a result, an image desired by the operator is recorded.

Next, one of the typical ink jet recording heads IJH in accordance with the present invention will be described.

An ink jet recording head in accordance with the present invention is such a recording head that is provided with means for generating thermal energy used as the energy for jetting liquid ink, and uses the thermal energy to cause ink to change in phase. With the use of this ink jetting method, this ink jet recording apparatus can record textual and graphical images at a high level of density and a high level of precision. In particular, in this embodiment, electrothermal transducers are employed as the means for generating thermal energy, and ink is jetted with the use of the pressure from the bubbles which generate as ink boils by being heated by the electrothermal transducers.

First, the general structure of the ink jet recording head in this embodiment will be described.

Figure 3A:
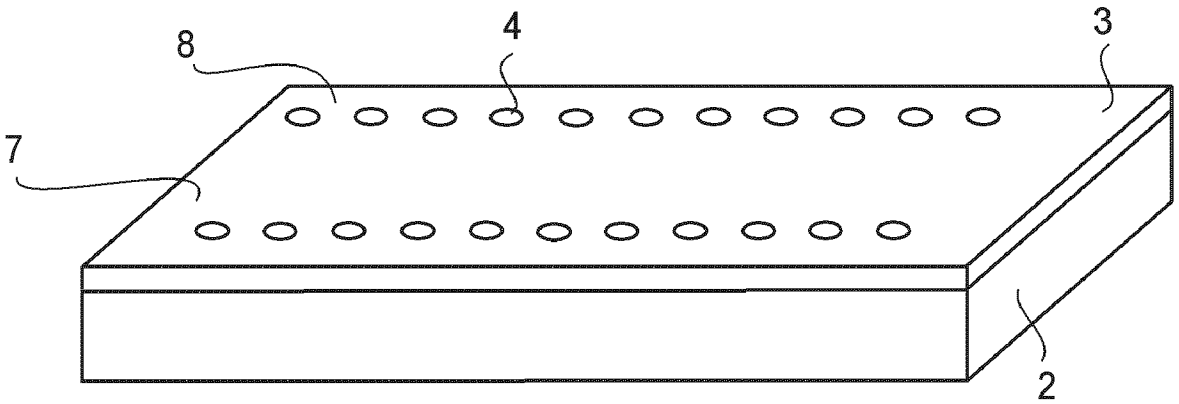
FIGS. 3A and 3B are schematic drawings of the ink jet recording head in the preferred embodiment of the present invention.
Figure 3B:
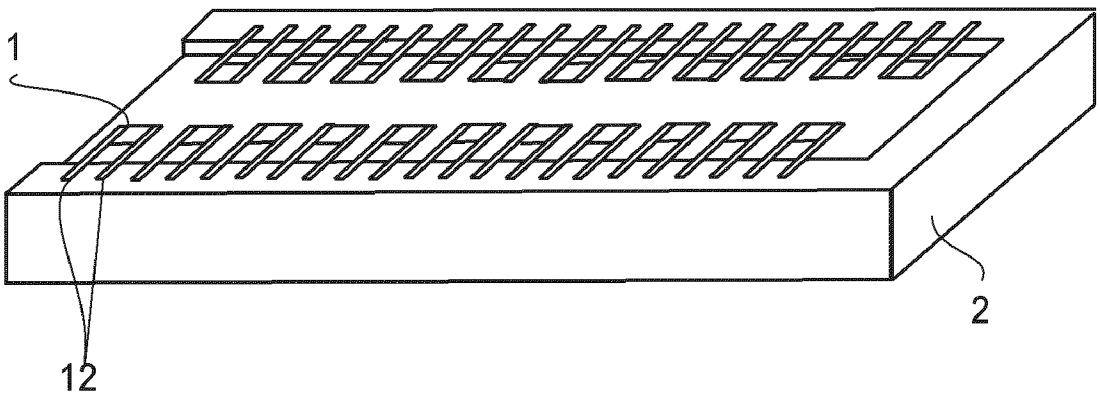

FIG. 3A is a schematic drawing of the ink jet recording apparatus in one of the preferable embodiments of the present invention. FIG. 3B is a schematic drawing of the ink jet recording head shown in FIG. 3A, minus its ink passage formation plate 3.

The substrate 2 of an ink jet recording head chip is formed of glass, ceramic, resin, metal, or the like: ordinarily, it is formed of Si. Heaters 1, and wiring 12 for applying voltage to the heaters 1, are disposed a preset distance away from the primary surface of the substrate 2, by removing preset portions of the substrate 2 by etching or the like method, as shown in FIG. 3B. The heaters 1 are covered with dielectric film (unshown) for enhancing heat dissipation. Further, the dielectric film is covered with protective film (unshown) to protect the heaters 1 from the cavitation which occurs when the bubbles collapse.

The liquid passage formation plate 3 for forming the liquid passage 5 is formed of metal, polysulfone, epoxy resin, or the like. The ink jet recording head configured as shown in FIG. 3 has multiple partitioning walls which separate two adjacent liquid passages 5, in each of which the heater 1 is provided. Each partitioning wall extends from the ink outlet 4 to a liquid supply chamber 6, which will be described later. The heater 1 is in the middle of a pressure chamber 10, that is, one of the spaces which the liquid passage formation plate 3 forms. The liquid (ink) outlet 4 is a part of the top wall (part of plate 3) of the pressure chamber 10. Further, the pressure chamber 10 is in connection to a liquid supply passage 9 through the hole in one of the lateral walls of the pressure chamber 10.

This ink jet recording head has multiple heaters 1 and multiple ink (liquid) passages. It also has two rows of ink outlets, that is, the first and second rows 7 and 8 of ink outlets, which are parallel to the lengthwise direction of each ink passage 5. In terms of the direction perpendicular to the lengthwise direction of each ink passage 5, the first row 7 of ink outlets is on one side of the ink supply chamber 6, whereas the second row 8 of ink outlets is on the other side of the ink supply chamber 6.

Hereafter, various structures for the ink jet recording head in accordance with the present invention will be described with reference to the preferred embodiments of the present invention.

Embodiment 1

Figure 4A:
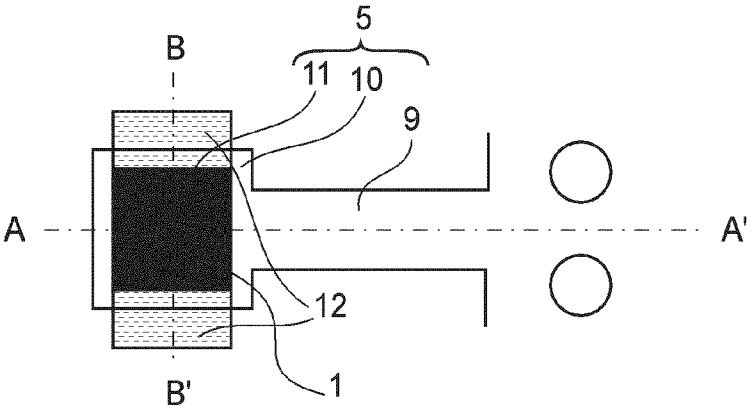
FIGS. 4A-4C are schematic drawings showing the structure of one of the liquid passages of the ink jet recording head in the first preferred embodiment of the present invention.
Figure 4B:
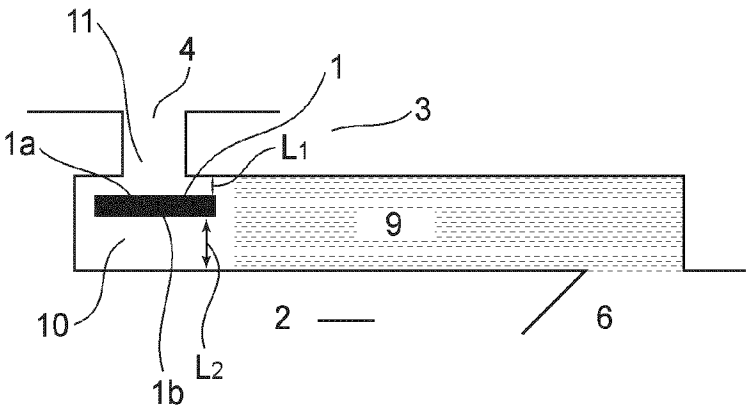
Figure 4C:
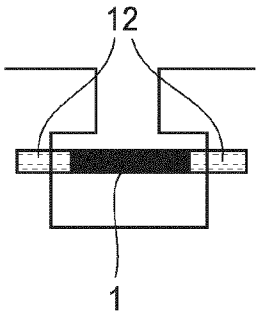

FIGS. 4A-4C are schematic drawings of the ink jet recording head in the first preferred embodiment of the present invention, and show the ink passage structure of the ink jet recording head. FIG. 4A is a schematic phantom plan view of the ink jet recording head, as seen from the direction perpendicular to the substrate of the ink jet recording head. FIG. 4B is a vertical sectional view of the ink jet recording head, at a plane which coincides with a line A-A' in FIG. 4A. FIG. 4C is a vertical sectional view of the ink jet recording head, at a plane which coincides with a line B-B' in FIG. 4A.

The ink jet recording head in this embodiment is provided with a substrate 2, and an ink passage formation plate 3 which is joined with the substrate 2 to form ink passages.

The ink passage formation plate 3 has multiple precursors of the ink passage 5 through which ink flows, and multiple precursors of the pressure chamber 10 which are in connection to the multiple precursors of the ink passage 5 one for one, and multiple ink outlets 4, which are the holes located at the downstream ends of the ink passages 5, one for one, in terms of the ink flow direction, and through which ink is jetted in the form of a droplet. The substrate 2 is provided with the ink supply chamber 6 through which ink is supplied to the ink passages 5 from the rear side of the substrate 2, that is, the side opposite to the primary surface which is in contact with the ink passage formation plate 3.

Each ink passage 5 has the pressure chamber 10, ink supply passage 9, and ink outlet portion 11. The pressure chamber 10 is the chamber in which bubbles are generated by the heater 1. The ink supply passage 9 is a part of the ink passage 5, which is next to the pressure chamber 10. The ink outlet portion 11 is a part of the ink passage 5, which includes the ink outlet 4. The ink jet recording head IJH is structured so that the portions of the internal surface of each ink passage 5, which correspond to the ink supply chamber 6 and pressure chamber 10, and oppose the primary surface of the substrate 2, are roughly parallel to the primary surface of the substrate 2.

Not only is the ink supply passage 9 in connection to the pressure chamber 10 by one of its lengthwise ends, but also, it is connected to the ink supply chamber 6 by the other end. The ink supply passage 9 is roughly uniform in width across its entire range, that is, from its end by which it is in connection with the ink supply chamber 6 to its end by which it is in contact with the pressure chamber 10. The configuration of the ink outlet 4 and the configuration of the ink supply passage 9 of the ink passage 5 are such that the direction in which ink is jetted out in the form of a droplet through the ink outlet 4 is perpendicular to the direction in which liquid ink flows through the ink supply passage 9 of the ink passage 5. The internal surface of the pressure chamber 10, which opposes the plane at which the outward end of the ink outlet 4 opens, is roughly rectangular.

The heater 1 is positioned so that its center coincides with the axial line of the ink outlet 4. The heater 1 is in connection to the wiring 12 for driving the heater 1. The heater 1 is suspended in the pressure chamber 10 by the wiring 12: the heater 1 and wiring 12 were positioned there by etching away the portions of the substrate 2, which surrounded them. The above described placement of the heater 1 makes it possible to form bubbles on both of the primary surfaces of the heater 1, that is, the first surface 1*a*, or the surface which faces the ink outlet 4, and the second surface 1*b*, or the surface which faces the substrate 2. Designated by an alphanumeric referential symbol L1 is the distance from the first surface 1*a* of the heater 1 to the top surface of the pressure chamber 10, and designated by an alphanumeric referential symbol L2 is the distance from the second surface 1*b* of the heater 1 to the bottom surface of the pressure chamber 10. In this embodiment, the distance L1, that is, the distance from the first surface 1*a* of the heater 1 to the top surface of the pressure chamber 10, is made shorter than the distance L2. That is, the placement of the heater 1 closer to the ink outlet 4 is for reducing the generation of satellite ink droplets (which hereafter may be referred to simply as satellites). With the first surface 1*a* being as close to the ink outlet 4 as described above, a bubble which generates on the first surface 1*a* and causes ink to jet in the form of a droplet from the ink jet recording head comes into contact with the ambient air while it is still growing. Therefore, the number and size of the satellites generated by the ink jet recording head in this embodiment are significantly smaller than those of the satellites generated by an ink jet recording head in accordance with the prior art.

Further, in the case of the heater 1 in this embodiment, not only does its first surface 1*a* generate a bubble, but also, its second surface generates a bubble at the same time, whereas an ink jet recording head in accordance with the prior art is such that a bubble is formed on only the first surface 1*a*, that is, the surface on the ink outlet side. In the case of an ink jet recording apparatus structured so that a bubble is generated on only the first surface 1*a*, ink continuously flows toward the ink supply chamber 6 even after the bubble comes into contact with the ambient air, making it difficult for the pressure chamber 10 to be quickly refilled with ink. In comparison, in the case of the ink jet recording head in this embodiment, the collapsing of the bubble which generated on the second surface 1*b* causes ink to flow toward the ink outlet 4, and therefore, the ink jet recording head in this embodiment is no less in refill efficiency than an ink jet recording apparatus, each of the heaters of which is on the bottom surface of the corresponding pressure chamber (10).

As described above, in this embodiment, the occurrence of the satellites, which is one of the primary causes of the formation of an inferior image by an ink jet recording apparatus in accordance with the prior art, is controlled by designing an ink jet recording head so that the heater 1 is positioned closer to the ink outlet 4 than in an ink jet recording head in accordance with the prior art. Further, in this embodiment, a certain amount of space is provided between the heater 1 and the substrate 2 so that the generation and collapsing of a bubble occur also on the second surface 1*b* of the heater 1. Therefore, the collapsing of a bubble on the second surface 1*b* can keep the ink jet recording apparatus in this embodiment just as high in refill efficiency as an ink jet recording apparatus in accordance with the prior art, each of the heaters of which is on the bottom surface of the corresponding pressure chamber (10).

Next, referring to FIGS. 5A-5D, the jetting of ink from the ink jet recording head in this embodiment, and the refilling of the pressure chamber of the ink jet recording head with ink, will be described.

Figure 5A:
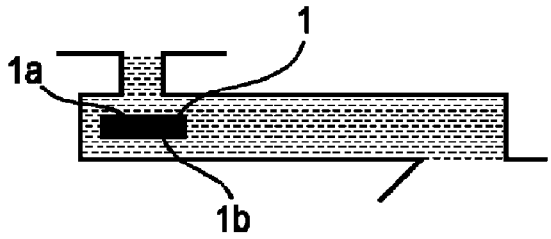
FIGS. 5A-5D are schematic drawings showing the jetting of ink from the ink jet recording head, and the refilling of the bubble generation chamber of the ink jet recording head, in the preferred embodiment of present invention.

FIG. 5A is a schematic sectional view of the ink jet recording head before bubble generation. When the ink jet recording head is in the state shown in FIG. 5A, a driving signal is yet to be inputted into the heater 1, and therefore, bubble generation has not begun on either the first surface 1*a* or the second surface 1*b*.

Figure 5B:
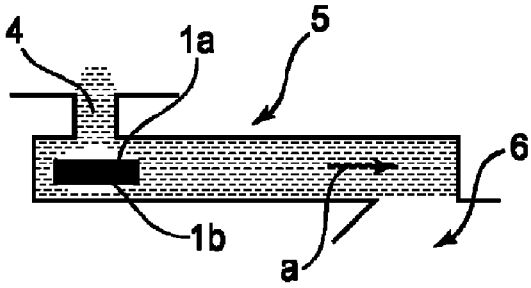

FIG. 5B is a schematic sectional view of the ink jet recording head immediately after bubbles began to grow. When the ink jet recording head is in the state shown in FIG. 5B, a driving signal has been inputted into the heater 1, and therefore, bubbles have begun to grow on the first and second surfaces 1*a* and 1*b*, one for one, causing the ink to begin to be jetted in the form of a droplet through the ink outlet 4. Further, ink has begun to flow toward (direction indicated by arrow mark a in drawing) the ink supply chamber 6, in the liquid passage 5.

Figure 5C:
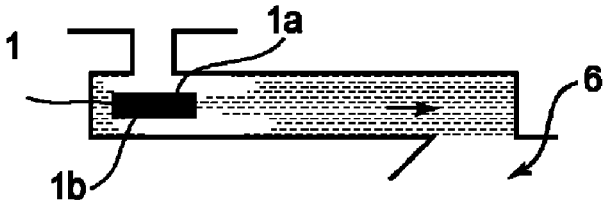

FIG. 5C is a schematic sectional view of the ink jet recording head immediately after the bubble generated on the first surface 1*a* came into contact with the ambient air. In the case of the ink jet recording head in this embodiment, the bubble generated on the first surface 1*a* is made to come into contact with the ambient air, by placing the heater 1*a* closer to the ink outlet 4 than in an ink jet recording head in accordance with the prior art. Therefore, the bubble generated on the first surface 1*a* jets an ink droplet while preventing the satellite generation. When the ink jet recording head is in the state shown in FIG. 5C, the bubble generated on the second surface 1*b* is still growing, and therefore, the ink in the ink passage 5 is flowing toward the ink supply chamber 6 (direction indicated by arrow mark a in the drawing). Incidentally, in the case of this embodiment of the present invention, it does not matter whether the bubble generated on the first surface 1*a* comes into contact with the ambient air while it is growing to its maximum size, or while it is contracting after it grew to the maximum size.

Figure 5D:
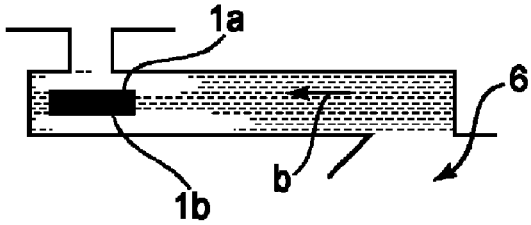

FIG. 5D is a schematic sectional view of the ink jet recording head during the refilling. When the ink jet recording head is in the state shown in FIG. 5D, the bubble generated on the second surface 1*b* has begun to collapse, causing thereby ink in the ink passage 5 to begin to flow toward the heater 1 from the ink supply chamber 6 (direction indicated by arrow mark b in drawing). In other words, in the case of this embodiment, the contraction of the bubble on the second surface 1*b* is utilized to refill the pressure chamber 10, and therefore, the ink jet recording head in this embodiment is significantly greater in refill efficiency than an ink jet recording head in accordance with the prior art. Further, the ink jet recording head in this embodiment is not structured so that each of its heaters 1 is on the protrusion (formed by etching substrate 2) which is protruding into the ink passage 5 from the bottom surface of the ink passage 5. Therefore, the ink supply passage 9, that is, the portion through which the ink outlet 4 and pressure chamber 10 are filled with ink, is not as small in cross-section as the counterpart in an ink jet recording head in accordance with the prior art, being therefore not as small in refill efficiency as the ink jet recording head in accordance with the prior art.

Incidentally, in the case of the ink jet recording head in this embodiment, the ink passage formation plate 3 is roughly 30 μm in overall thickness, roughly 8 μm in the diameter of the ink outlet 4, roughly 10 μm in the thickness of the wall of the ink outlet 4, and roughly 3 μm in the distance from the heater 1 to the bottom end of the ink outlet portion 11, and the heater 1 is roughly 10 μm in thickness. That is, the distance from the first surface 1*a* of the heater 1 to the top end of the ink outlet portion 11 is smaller than the distance from the second surface 1*b* of the heater 1 to the substrate 2 (bottom of ink passage 5). However, the specification, in terms of measurement, of the ink jet recording head in this embodiment, given above, is not intended to limit the present invention in scope. However, for the purpose of obtaining the best result from the application of the present invention, the distance from the heater 1 to the bottom end of the ink outlet portion 11 is no more than 11 μm, and the thickness of the heater 1 is 10 μm.

Embodiment 2

Figure 6A:
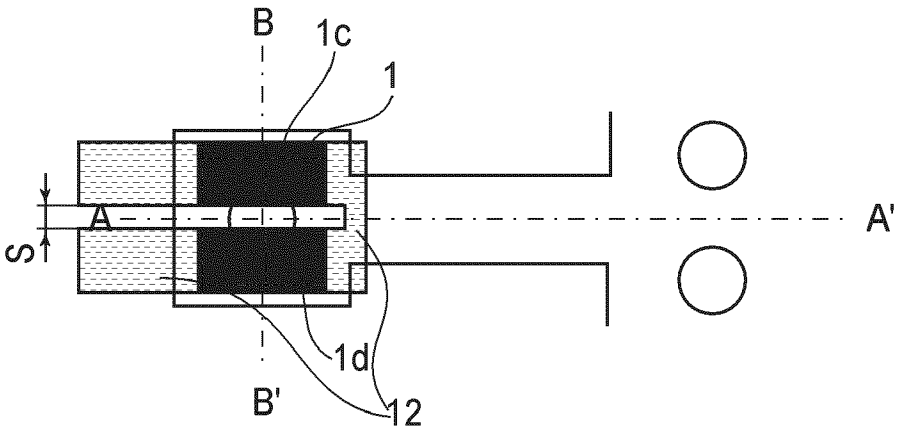
FIG. 6A-6C are schematic drawings showing the ink passage structure of the ink jet recording head in the second embodiment of the present invention.
Figure 6B:
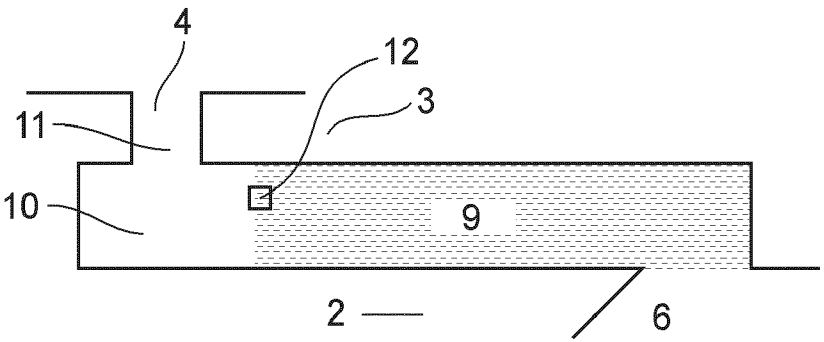
Figure 6C:
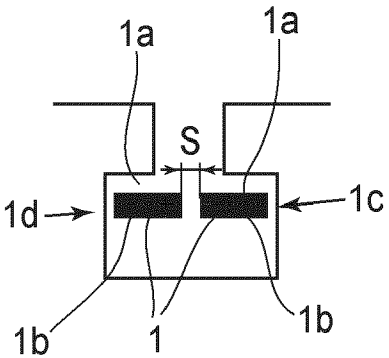

FIGS. 6A-6C are schematic plan views of the ink jet recording head in the second preferred embodiment of the present invention, and show the ink passage structure of the head. FIG. 6A is a phantom plan view of a part of the ink jet recording head, as seen from the direction perpendicular to the substrate of the ink jet recording head. FIG. 6B is a vertical sectional view of the ink jet recording head, at a plane which coincides with a line A-A' in FIG. 6A. FIG. 6C is a vertical sectional view of the ink jet recording head, at a plane which coincides with a line B-B' in FIG. 6A.

The structure of the ink jet recording head in this embodiment is different from that in the first embodiment in that each of the heaters 1 in this embodiment is made of two smaller heaters, which are positioned a preset distance away from each other, as will be described later. Otherwise, the two structures are basically the same. Thus, the components of the ink jet recording head in this embodiment, which are similar to the counterparts in the first embodiment, are given the same referential symbols as those given to the counterparts, and will be described only regarding their differences from the counterparts.

In the case of the ink jet recording head in this embodiment, each of its heaters 1 is made up of a heater 1*c* and a heater 1*d*, which are juxtaposed in parallel with the presence of a preset amount of gap S. With the provision of the gap S, the first surface 1*a* side of the heater 1 is in connection to the second surface 1*b* side of the heater 1 through the gap S. The heaters 1*c* and 1*d* are connected in series with the wiring 12. The amount of the gap S between the heaters 1*c* and 1*d* in this embodiment is roughly 3 μm.

In the case of the ink jet recording head in this embodiment, when the bubble on the second surface 1*b* side collapses, a part of the body of ink on the second surface 1*b* side is supplied to the first surface 1*a* side through the gap S between the heaters 1*c* and 1*d*. Therefore, the ink jet recording head in this embodiment is greater in refill speed than an ink jet recording head which does not have the gap S.

Also in the case of the ink jet recording head in this embodiment, the satellite generation, which is one of the primary causes of the formation of an inferior image, is controlled by placing the heaters 1*c* and 1*d* closer to the ink outlet 4 as in the first embodiment. Further, the heater 1 is positioned so that a certain amount of space is provided between the second surface 1*b* and the substrate 2 to allow a bubble to generate and collapse even on the second surface 1*b*. Thus, the contraction (collapsing) of the bubble on the second surface 1*b* contributes to the refilling process. Moreover, the structure of the ink jet recording head in this embodiment is such that ink is supplied to the first surface 1*a* side from the second surface 1*b* side through the gap S. Therefore, the ink jet recording head in this embodiment is significantly greater in refill speed than that in the first embodiment.

Embodiment 3

Figure 7A:
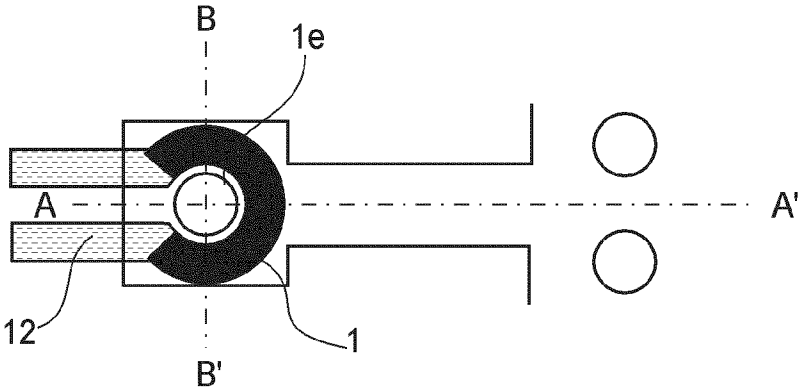
FIG. 7A-7C are schematic drawings showing the ink passage structure of the ink jet recording head in the third embodiment of the present invention.
Figure 7B:
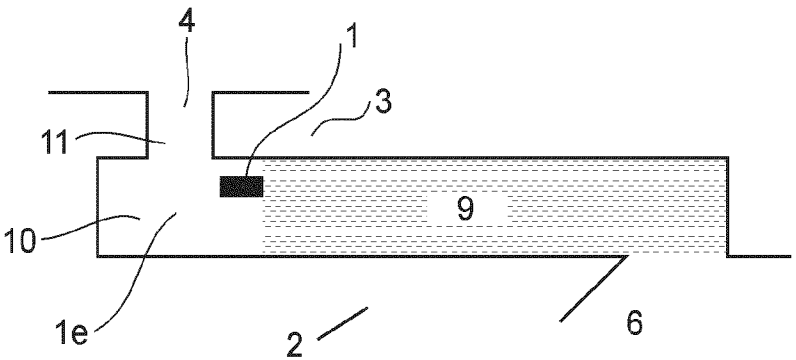
Figure 7C:
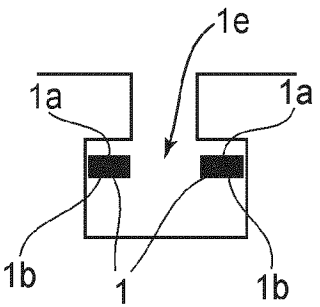

FIGS. 7A-7C are schematic drawings of the ink jet recording head in the third preferred embodiment of the present invention, and show the ink passage structure of the ink jet recording head. FIG. 7A is a schematic phantom plan view of the ink jet recording head, as seen from the direction perpendicular to the substrate of the ink jet recording head. FIG. 7B is a vertical sectional view of the ink jet recording head, at a plane which coincides with a line A-A' in FIG. 7A. FIG. 7C is a vertical sectional view of the ink jet recording head, at a plane which coincides with a line B-B' in FIG. 7A.

The structure of the ink jet recording head in this embodiment is different from that in the first embodiment in that each of the heaters 1 in this embodiment is roughly in the form of a ring. Otherwise, the two structures are basically the same. Thus, the components of the ink jet recording head in this embodiment, which are similar to the counterparts in the first embodiment are given the same referential symbols as those given to the counterparts, and will be described only regarding their differences from the counterparts.

In the case of the ink jet recording head in this embodiment, its heaters 1 are roughly in the form of a ring, the center of which coincides with the axial line of the ink outlet 4. The first and second surfaces 1*a* and 1*b* are in connection with each other through the center hole 1*c* of the roughly ring-shaped heater 1. Thus, ink is allowed to flow between the first surface 1*a* side and second surface 1*b* side through the center hole 1*c*.

Since the heater 1 is roughly in the form of a ring, a bubble is generated roughly in the form of a ring. Thus, when ink is jetted, a roughly ring-shaped bubble wraps around the bottom end of the ink outlet portion 11, preventing thereby ink from trailing the ink droplet (primary ink droplet) which is flying away. Therefore, the satellite generation, which is one of the primary causes of the formation of an inferior image, is reduced.

Further, since the heater 1 is roughly in the form of a ring, the body of ink on the second surface 1*b* side can be supplied to the first surface 1*a* side through the center hole 1*e*. Therefore, the ink jet recording head in this embodiment is significantly greater in refill speed than that in the first embodiment.

As described above, also in the case of the ink jet recording head in this embodiment, the satellite generation, which is one of the primary causes of the formation of an inferior image is controlled by placing the heater 1 closer to the ink outlet 4 as in the first embodiment. Further, the heater 1 is positioned so that a certain amount of space is provided between the second surface 1*b* and the substrate 2 to allow the generation and contraction (collapsing) of a bubble to occur on the second surface 1*b*. Thus, the contraction (collapsing) of a bubble on the second surface 1*b* contributes to the refilling process. Moreover, the structure of the ink jet recording head in this embodiment is such that ink is supplied to the first surface 1*a* side from the second surface 1*b* side through the center hole 1*e*. Therefore, the ink jet recording head in this embodiment is significantly greater in refill speed than that in the first embodiment.

Embodiment 4

Figure 8A:
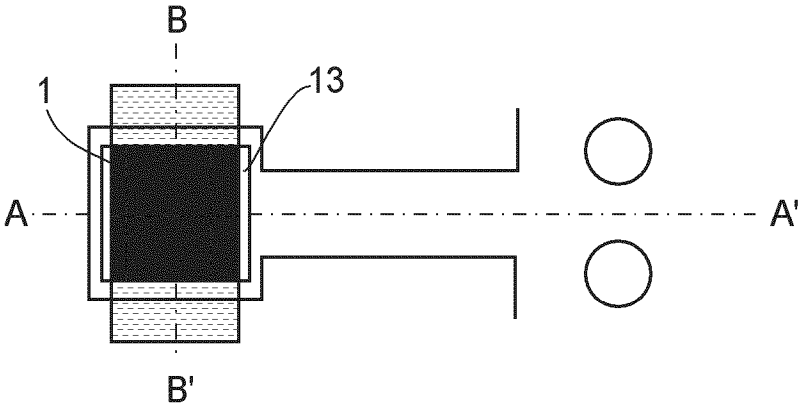
FIG. 8A-8C are schematic drawings showing the ink passage structure of the ink jet recording head in the fourth embodiment of the present invention.
Figure 8B:
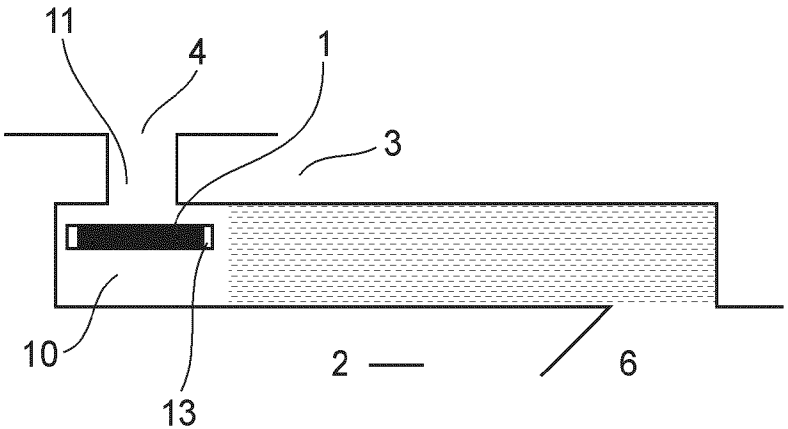
Figure 8C:
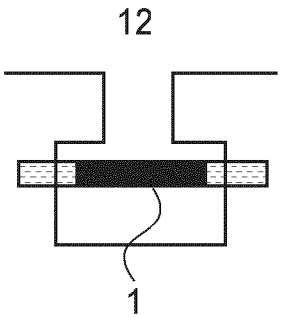
Figure 9:
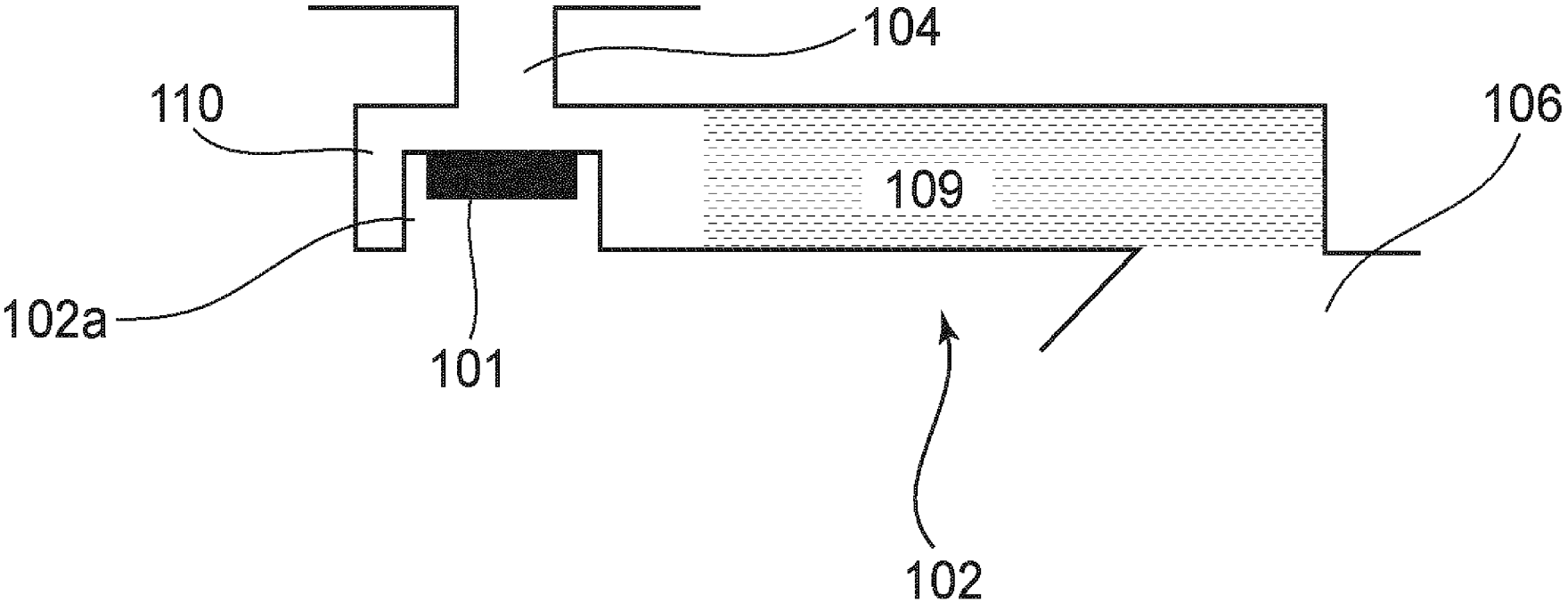
FIG. 9 is a schematic drawing showing the structure of an ink jet recording apparatus, in accordance with the prior art, the ink supply passage of which is provided with a projection for placing a heater closer to the corresponding ink outlet.
Figure 10A:
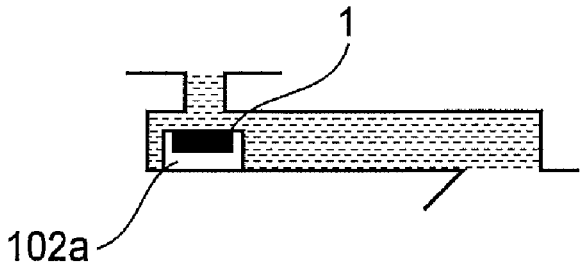
FIGS. 10A-10E are schematic drawings showing the jetting of ink from the ink jet recording head shown in FIG. 9, and the refilling of the bubble generation chamber of the ink jet recording head shown in FIG. 9, with ink.
Figure 10B:
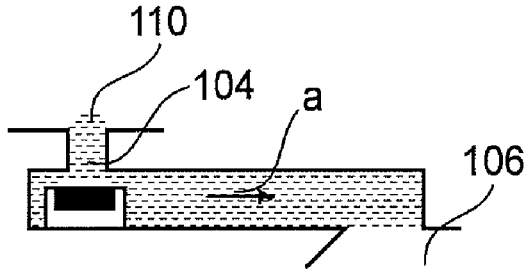
Figure 10C:
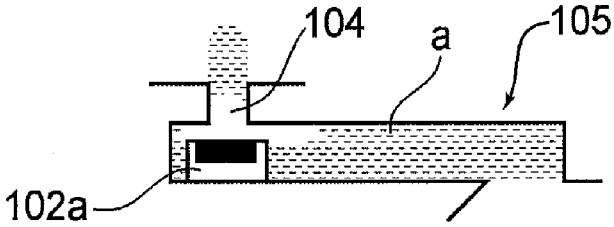
Figure 10D:
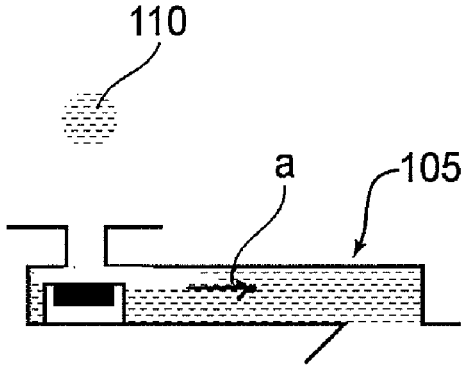
Figure 10E:
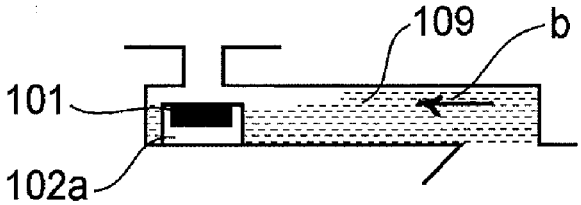

FIGS. 8A-8C are schematic drawings of the ink jet recording head in the fourth preferred embodiment of the present invention, and show the ink passage structure of the ink jet recording head. FIG. 8A is a schematic phantom plan view of the ink jet recording head, as seen from the direction perpendicular to the substrate of the ink jet recording head. FIG. 8B is a vertical sectional view of the ink jet recording head, at a plane which coincides with a line A-A' in FIG. 8A. FIG. 8C is a vertical sectional view of the ink jet recording head, at a plane which coincides with a line B-B' in FIG. 8A.

The structure of the ink jet recording head in this embodiment is different from that in the first embodiment in that the ink jet recording head in this embodiment is provided with members for preventing bubbles from uniting, which are positioned around the heater. Otherwise, the two structures are basically the same. Thus, the components of the ink jet recording head in this embodiment, which are similar to the counterparts in the first embodiment, are given the same referential symbols as those given to the counterparts, and will be described only regarding their differences from the counterparts.

Referring to FIG. 8A, in this embodiment, the ink jet recording head is provided with a couple of members 13 for preventing bubbles from uniting. The members 13 do not generate thermal energy, and are attached to the lateral surfaces of the heater 1 other than the lateral surfaces by which the heater 1 is suspended in the pressure chamber 10 by the lateral surfaces of the chamber 10. They are attached to the heater 1 in such a manner that they appear as if they are extensions of the heater 1. More specifically, the members 13 are for preventing a bubble generated on the first surface 1*a* from uniting with a bubble generated on the second surface 1*b*. In the case of an ink jet recording head which is not provided with the members 13, that is, the members for preventing bubbles from uniting, which are positioned in a manner to surround the heater 1, the bubble generated on the first surface 1*a* is likely to go around the edges of the heater 1 and unite with the bubble generated on the second surface 1*b*, and vice versa. As the two bubbles unite, the resultant bubble comes into contact with the ambient air, and therefore, does not collapse, failing thereby to contribute to the refilling process. In order to prevent the occurrence of this problem, it is necessary to keep the bubble on the first surface 1*a* and the bubble on the second surface 1*b* separated from each other. As for the means for keeping the two bubbles separated, it is possible to increase the heater 1 in thickness, for example. However, increasing the heater 1 in thickness narrows the ink passage, drastically reducing thereby the ink jet recording head in refill speed.

In the case of this embodiment, the members 13, that is, the members for preventing bubbles from uniting, are attached to the lateral walls of the heater 1. Therefore, the distance between the first and second surfaces 1*a* and 1*b*, that is, the heater generating surfaces, is greater by the amount increased by the provision of the members 13 than that in the first embodiment. In other words, the distance between the first and second surfaces 1*a* and 1*b* of the heater 1 is increased without increasing the heater 1 in thickness. As described above, in the case of this embodiment, a bubble which generated on the first surface 1*a* is prevented by the members 13, that is, the members for preventing bubbles from uniting, from going around the edges of the heater 1 and uniting with the bubble which generated on the second surface 1*b*, and vice versa. That is, the two bubbles are prevented from uniting, without increasing the heater 1 in thickness. Therefore, it is possible to keep the refill efficiency of the ink jet recording head at a satisfactory level.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 272985/2006 filed Oct. 4, 2006, which is hereby incorporated by reference herein.

What is claimed is:

1. A liquid recording head comprising:

thermal energy generating means, having a flat plate configuration, for generating a bubble by thermal energy;

a pressure chamber in which said thermal energy generating means is provided;

a flow path for introducing liquid into said pressure chamber;

a supply port in fluid communication with said flow path; and an ejection outlet provided at a position opposing said thermal energy generating means in fluid communication with said pressure chamber, wherein said thermal energy generating means includes a first major surface facing said ejection outlet and a second major surface opposite said first major surface, and wherein a distance between said first major surface and a ceiling surface of said pressure chamber in which said ejection outlet is formed is shorter than a distance between said second major surface and a bottom surface of said pressure chamber.

2. A recording head according to claim 1, wherein said thermal energy generating means is supported by a side wall surface of said pressure chamber at a side portion of said thermal energy generating means.

3. A recording head according to claim 2, wherein said thermal energy generating means is provided with a non-bubble-generation region not producing the thermal energy enough to generate a bubble of the liquid, in a region other than that supported by said side wall surface.

4. A recording head according to claim 1, wherein said thermal energy generating means is provided with a communicating portion for fluid communication between a first major surface side and a second major surface side of said pressure chamber.

5. A recording head according to claim 4, wherein said thermal energy generating means has an annular portion constituting the communicating portion at a central portion thereof, and said central portion is disposed at a position corresponding to said ejection outlet.

6. An apparatus according to claim 1, wherein said thermal energy generating means is disposed so as to be axially symmetrical with respect to a center axis of said ejection outlet.

7. A recording head according to claim 1, wherein a distance between said first major surface and the ceiling surface is not more than 4 μm.

8. A recording head according to claim 1, wherein said thermal energy generating means has a thickness not more than 10 μm.

9. A liquid ejecting method comprising the steps of:

providing a liquid recording head including thermal energy generating means, having a flat plate configuration, for generating a bubble by thermal energy, a pressure chamber in which the thermal energy generating means is provided, a flow path for introducing liquid into the pressure chamber, a supply port in fluid communication with the flow path, and an ejection outlet provided at a position opposing the thermal energy generating means in fluid communication with the pressure chamber, wherein the thermal energy generating means includes a first major surface facing the ejection outlet and a second major surface opposite the first major surface; and activating the liquid recording head such that the bubble generated on the first major surface is brought into fluid communication with ambience through the ejection outlet, and the bubble generated on the second major surface collapses without communication with the ambience.

* * * * *